US009525951B2

(12) United States Patent
Park

(10) Patent No.: US 9,525,951 B2
(45) Date of Patent: Dec. 20, 2016

(54) SPEAKER-ORIENTED HEARING AID FUNCTION PROVISION METHOD AND APPARATUS

(71) Applicant: Samsung Electronics Co., Ltd., Gyeonggi-do (KR)

(72) Inventor: Jin Park, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 588 days.

(21) Appl. No.: 13/901,721

(22) Filed: May 24, 2013

(65) Prior Publication Data

US 2013/0337786 A1 Dec. 19, 2013

(30) Foreign Application Priority Data

Jun. 18, 2012 (KR) ..... 10-2012-0064812

(51) Int. Cl.
*H04R 25/00* (2006.01)

(52) U.S. Cl.
CPC ..... *H04R 25/60* (2013.01); *H04R 25/43* (2013.01); *H04R 25/554* (2013.01); *H04R 25/70* (2013.01)

(58) Field of Classification Search
CPC ..... H04W 29/08108
See application file for complete search history.

(56) References Cited

U.S. PATENT DOCUMENTS 7,680,465 B2 * 3/2010 Zad-Issa ..... H04R 25/43 381/104
2005/0086058 A1 * 4/2005 Lemelson ..... H04R 5/04 704/270
2008/0025538 A1 1/2008 Zad-Issa
2008/0057858 A1 * 3/2008 Smith ..... H04R 1/1033 455/3.05
2009/0074214 A1 3/2009 Bradford et al.
2011/0216928 A1 * 9/2011 Eisenberg ..... H04R 25/00 381/315
2012/0099747 A1 * 4/2012 Waldron ..... H04M 1/6016 381/312

(Continued)

FOREIGN PATENT DOCUMENTS

WO 2004/016037 A1 2/2004

OTHER PUBLICATIONS

European Search Report dated Aug. 12, 2013; 6 pages.

*Primary Examiner* — Vladimir Magloire
*Assistant Examiner* — Frank Donado
(74) *Attorney, Agent, or Firm* — Cha & Reiter, LLC.

(57) ABSTRACT

A hearing aid function provision method and apparatus is provides a hearing-impaired person with the audio enhanced based on the hearing-impaired information shared through Social Network Service (SNS). A user device operates in an environment-adaptive hearing-aid mode. The hearing aid function method includes receiving, at the device, audio input by a device owner; enhancing the audio based on hearing impairment information of a hearing impaired person; and outputting the enhanced audio. The audio may be enhanced a number of ways that include amplification, shifting, spreading, and division that can be based on an audiogram performed by the device or such information provided to the device.

12 Claims, 11 Drawing Sheets

(56) References Cited

U.S. PATENT DOCUMENTS

2012/0183164 A1* 7/2012 Foo ..... H04R 25/70
381/314
2012/0282976 A1* 11/2012 Suhami ..... G10K 11/1786
455/556.1

* cited by examiner

SPEAKER-ORIENTED HEARING AID FUNCTION PROVISION METHOD AND APPARATUS

CLAIM OF PRIORITY

This application claims the benefit of priority under 35 U.S.C. §119(a) from a Korean patent application filed on Jun. 18, 2012 in the Korean Intellectual Property Office and assigned Serial No. 10-2012-0064812, the entire disclosure of which is hereby incorporated by reference in its entirety.

BACKGROUND

Field of the Invention

The present disclosure relates to a hearing aid function provision method and apparatus. More particularly, the present invention relates to a user device capable of operating in an environment-adaptive hearing-aid mode.

Description of the Related Art

A hearing-impaired person is someone who has difficulty hearing in everyday conversations, i.e. the person being hearing-impaired being unable to perceive sound as is typically perceived by the one with normal hearing. In order for the hearing-impaired individual to live everyday life with less difficulty, the use of a hearing aid can help compensate for hearing loss. The hearing aid is a device that can amplify sound waves in order to help hear sound more clearly. While there amplification does not always function as well as normal human hearing because of the amplification of background noise, hearing aids continue to improve in quality over time.

Typically, the hearing aid includes a microphone that receives sound waves and converts them into electrical signals, an amplifier that rectifies and amplifies the electric signals, a receiver that converts the amplified signals into sound and sends the sounds into the ear canal, and a battery that supplies power to the microphone, the amplifier, and the amplifier. There are various types of hearing aids: box type aid, behind-the-ear aid, eyeglass type aid, in-the-ear aid, and in-the-canal aid evolved from in-the-ear aid.

However, the conventional hearing aid devices are relatively expensive to buy and thus research and development is being conducted on the technology for implementing a hearing aid function more inexpensively than known heretofore.

SUMMARY

The present invention provides a hearing aid function provision method and apparatus that is provides a hearing-impaired person with the audio enhanced based on the hearing-impaired information shared through Social Network Service (SNS). The present invention can utilize a portable terminal, which most people now carry around in their everyday lives.

The present invention provides a speaker-oriented hearing aid function provision method and apparatus for assisting a hearing-impaired to hear sound normally without wearing extra hearing aid device.

The present invention provides a speaker-oriented hearing aid function provision method and apparatus for assisting a hearing-impaired person to hear a source by operating the user device in a hearing-aid mode adaptive to the environment.

It is an exemplary object of the present invention to provide a speaker-oriented hearing aid function provision method and apparatus that can share hearing-impaired information among the hearing-impaired and others (e.g. family members, friends, acquaintances, coworkers, etc.) through a Social Network Service (SNS) to allow one of the others to provide the hearing-impaired with the audio compensated information based on the hearing-impaired information through a speaker or radio communication channel.

It is another exemplary object of the present invention to provide a speaker-oriented hearing aid function provision method and apparatus for assisting a hearing-impaired that is can provide the hearing-impaired with noise-cancelled sound by performing noise cancelation on the audio input to the user device operating in the speaker-oriented hearing aid mode.

It is still another exemplary object of the present invention to provide a speaker-oriented hearing aid function provision method and apparatus that is capable of improving the convenience of the user and the usability and competitiveness of the user device with the integration of the environment-adaptive hearing aid function.

In accordance with an aspect of the present invention, a hearing aid function provision method of a device can include receiving, at the device, audio input by a device owner; enhancing the audio based on hearing impairment information of a hearing impaired person; and outputting the enhanced audio.

In accordance with another aspect of the present invention, a hearing aid function provision method of a device can include determining a sub-mode of a current hearing aid mode of the device; selecting one of audio paths to a loud speaker of the device and a communication unit depending on the sub-mode; enhancing input audio based on a hearing impairment information of a hearing impaired person; and outputting the enhanced audio to the loud speaker of the device.

In accordance with still another aspect of the present invention, a hearing aid function provision method of a device can include receiving a feedback in response to a call setup request; suspending, when the feedback indicates call setup request retransmission in a hearing aid mode, the call setup; switching from a normal telecommunication mode to a hearing aid telecommunication mode according to the feedback; retransmitting the call setup request in the hearing aid telecommunication mode; and processing, when call setup is established, telecommunication based on the hearing impairment information in the hearing aid telecommunication mode.

In accordance with yet another aspect of the present invention, a hearing aid function provision method of a device can include transmitting, at a user device, a call setup request to a call server according to contact information; searching, at the call server, a hearing impairment information database for the hearing impairment information mapped to the contact information in response to the call setup request; transmitting, when any hearing impairment information mapped to the contact information exists, the feedback requesting for transmission of the call setup request; retransmitting the call setup request after switching from the normal telecommunication mode to the hearing aid telecommunication mode; enhancing the audio input through a microphone based on the hearing impairment information; and transmitting the enhanced audio through a radio communication unit.

In accordance with even another aspect of the present invention, a hearing aid function provision method of a device can includes receiving a call request input; determining whether any hearing impairment information is mapped to the contact information checked from the call request; transmitting, when no hearing impairment information is mapped to the contract information, the call setup request in a normal call setup procedure; switching, when any hearing information is mapped to the contact information, from the normal telecommunication mode to the hearing aid telecommunication mode; acquiring the hearing impairment information mapped to the contact information; transmitting the call setup request based on the acquired contact information; and processing, when the call setup is established, telecommunication based on the acquired hearing impairment information in the hearing aid telecommunication mode.

In accordance with a further aspect of the present invention, a non-transitory computer-readable storage medium stores a program of machine executable code for executing a processor of executing the above-described method.

In accordance with yet a further aspect of the present invention, a device includes a storage unit comprising a non-transitory machine readable memory which stores at least one program comprising machine executable code; and a control unit comprising hardware such as a processor or microprocessor loaded with machine executable code which controls executing the at least one program, enhancing audio input based on a hearing impairment information, and outputting the enhanced audio, wherein the at least one program comprises commands of receiving audio input; enhancing the audio based on the hearing impairment information of a hearing impaired person; and outputting the enhanced audio.

In accordance with still another aspect of the present invention, a non-transitory computer-readable storage medium stores a program comprising machine executable code for configuring hardware with a hearing aid mode in adaptation to a hearing aid application environment, enhancing input audio based on hearing impairment information shared through Social Network Service (SNS) in the hearing aid mode, and outputting the enhanced audio.

The foregoing has outlined some of the aspects and technical advantages of the present invention in order that the detailed description of the invention that follows may be better understood by a person of ordinary skill in the art. Additional examples and advantages of the invention will be described hereinafter which form the subject of the claims of the invention.

DETAILED DESCRIPTION

Exemplary embodiments of the present invention are described herein below with reference to the accompanying drawings in more detail. The same reference numbers are typically used throughout the drawings to refer to the same or like parts. Detailed descriptions of well-known functions and structures incorporated herein may be omitted to avoid obscuring appreciation of the subject matter of the present invention by a person of ordinary skill in the art.

It should also be understood that while the term "device owner" may be user in the specification and claims, this term is to be interpreted as meaning any user of the device and is not limited to an owner.

The present invention provides a method and apparatus for supporting a speaker-oriented hearing-aid function of a user device. According to an exemplary embodiment of the present invention, the audio input is enhanced at the sending party (other than the receiving party) such that the enhanced sound is output through a loud speaker of the sender's device or transmitted to the receiver's device through radio or other wireless communication channel.

More particularly in an exemplary embodiment of the present invention, the user device provides assistance to the hearing-impaired user to hear the sound normally without wearing a conventional hearing aid device. The hearing aid method and device according examples of the present invention can share the hearing-impairment information of the hearing-impaired person with the others (family members, friends, acquaintances, coworkers, etc.) through, for example a Social Networking Service (SNS) such that the speech of the information sharer is enhanced on the basis of the impairment information provided, and then output through a loud speaker or transmitted through a radio channel according to the conversation environment.

The structure and control method of the user device according to an exemplary embodiment of the present invention is described hereinafter with reference to accompanying drawings. However, the structure and control method of the user device of the present invention are not limited in any way to the following illustrative description but can be implemented with various modifications without departing from the spirit of the present invention and the scope of the appended claims.

Figure 1:
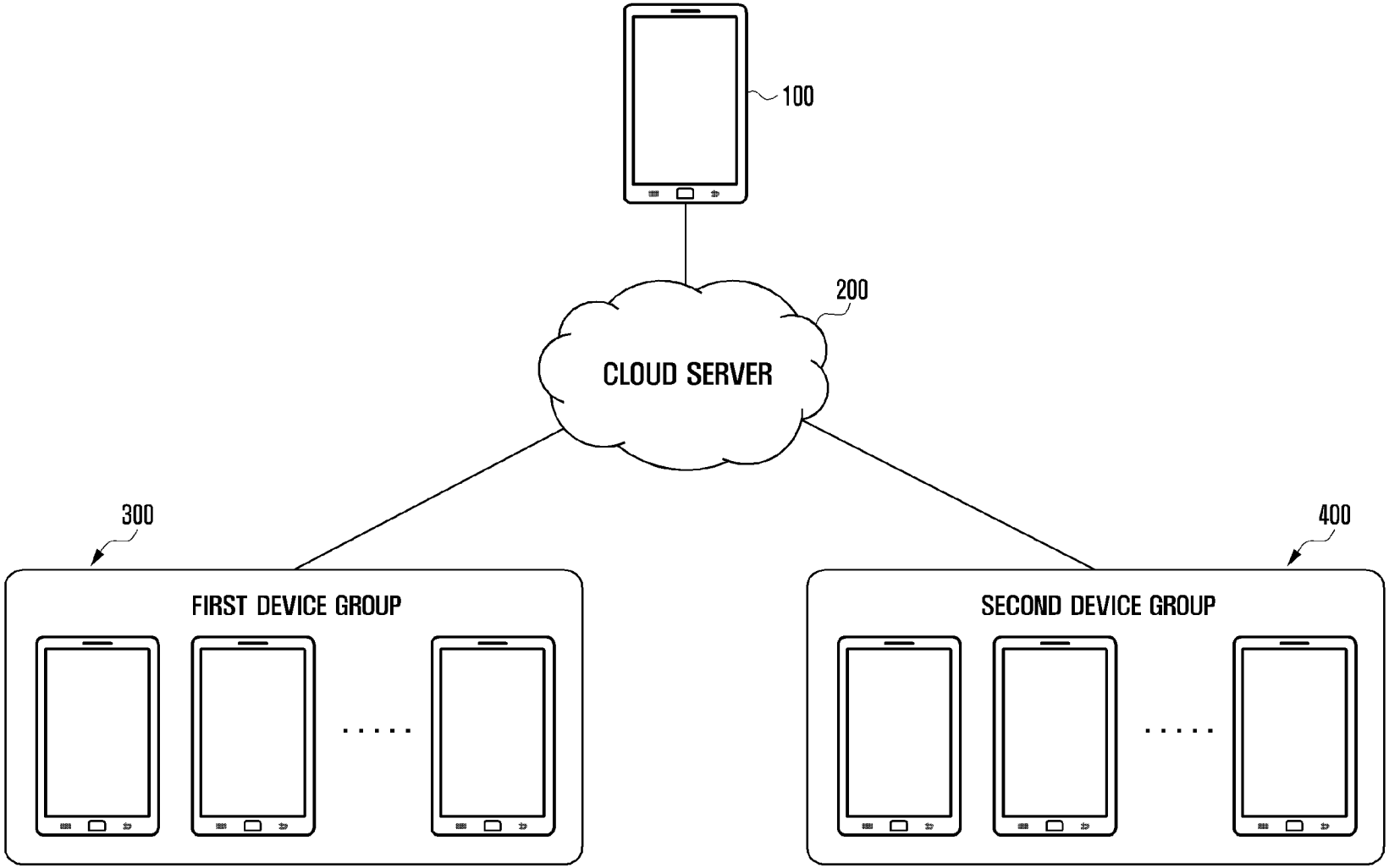
FIG. 1 is a diagram illustrating exemplary architecture of the speaker-oriented hearing-aid system according to an exemplary embodiment of the present invention.

FIG. 1 is a diagram illustrating the architecture of the speaker-oriented hearing-aid system according to an exemplary embodiment of the present invention.

Referring now to FIG. 1, the speaker-oriented hearing-aid system can includes a user device 100, a cloud server 200, a first device group 300, and a second device group 400. Although an exemplary speaker-oriented hearing-aid system is depicted in FIG. 1, the present invention is not limited thereto but may be implemented with more or less components than shown in FIG. 1. Also, for example, although the user device in the example is a portable terminal, tablet, etc., the invention is not limited thereto.

FIG. 1 is directed to the speaker-oriented hearing-aid system where the user device 100 is the hearing aid-enabled device owned by a hearing impaired user. The user device 100 sends the hearing impairment information about the hearing-impaired user to the cloud server 200 to share the information with others through SNS. However, while a cloud server is shown, it should be appreciated that the present invention is applicable in a peer-to-peer system, in which the user device can send the information to devices in the first or second device group in a peer-to-peer mode, or via access points acting as relays.

The user device 100 connects to the cloud server 200 through any known method, such as, for example, a cellular communication network or Wireless Local Area Network (WLAN) to transmit the impairment information. When the user device 100 determines to share the impairment information, the user device can configure the information sharing range of the impairment information as a default that can be changed by the use or subsequent update/upgrade of the user device. For example, the user can set or change the information sharing range to at least one social relationship formed in the SNS or all of the SNS users.

In the present invention, the hearing impairment information can include, for example, frequency (Hz) and intensity (dB) as the criteria indicating a user audiogram and further guide information for guiding the speaker and configuration information corresponding to one or more the hearing aid mode operation types optionally depending on an example to be described herein later. The hearing impairment information on the hearing impaired person can be stored, for example, in a non-transitory medium in the user device 100 in response to the user request. The hearing impairment information may include the hearing impairment information acquired through the audiogram measurement by operation of the user device 100. Accordingly, the user device 100 can include a module that is loaded into the controller/processor for measuring an audiogram of the hearing-impaired user. In other words, the user device can administer a hearing test, or the audiogram information can also be received from an audiologist or someone else who has administered a hearing exam. The information can be sent in an email, SMS, etc. As patient privacy is a major concern in the United States, some or all of this information can be encrypted. The measurement could involve using a head set to individually test the left and right ears, or holding the mobile terminal to a particular ear as would normally be performed during a conversation, or testing hearing in a speakerphone mode. In addition, the measuring by the device can be made in to supplement or update previous information. In addition, it is within the spirit and scope of the claimed invention that the user device can also automatically or by user prompt notify a doctor, audiologist, or other administrative personnel with the results, and can flag the results when there is a degree of change greater than a predetermined threshold. In fact another aspect of the invention is eliminating the need in many instances for anyone to visit an audiologist for a hearing test, as it can be administered by the user device. In this regard, the test could be an application ("app") that a user obtains from, or updates via the cloud server.

The cloud server 200 is can store the hearing-impairment information registered by the user device for sharing in an internal database (DB) (not shown). The information can be encrypted by the user or at the cloud. Users who receive the information may also obtain a key to decrypt this information, so that the user is not merely making public personal health information with regard to a degree of hearing impairment. If the hearing impairment information is transmitted by the user device 100, the cloud server 200 can store the device information on the user device 100 (e.g. device identifier, contact information (phone number), etc.) in the user-specific hearing impairment information table. The hearing impairment information table can be formed as Table 1.

TABLE 1

| Device | Range | Audiogram |
|---|---|---|
| User device A (contact info., ID) | Friends | Matrix 1 (F0, x) |
| User device B (contact info., ID) | Family, friends | Matrix 2 (F1, y) |
| User device C (contact info., ID) | X (All) | Matrix 3 (F2, z) |
| . . . | . . . | . . . |

Referring now to table 1, the cloud server 200 receives the hearing impairment information from the user devices A, B, and C and records the hearing impairment information sharing ranges (e.g. friend, family, and all) of the user devices in the state of being mapped to the audiograms. The audiogram can be configured in the form of a matrix and including audible frequency and intensity.

The cloud server 200 can control sharing the per-device hearing impairment information recorded in the hearing impairment information DB among the user devices (e.g. first and second device groups 300 and 400) through SNS, or an alternative network.

With continued reference to FIG. 1, the first and second device groups 300 and 400 are the groups of the hearing impaired user devices sorted by device type from among hearing impaired user devices sharing the hearing impaired information by the cloud server 200.

For example, the first device group 300 is the group of the hearing impaired user devices having a relationship with the user device 100 through SNS. The second device group 400 can be a group of devices owned by the user of the user device 100 (e.g. tablet PC (Personal computer), smartphone, home phone, TV (Television), game console, etc.). The devices belonging to the first and second device groups 300 and 400 can acquire the hearing impairment information of the user device 100 from the cloud server 200 and store the acquired information. In other words, the hearing impairment information provided by the user device 100 can be shared with other SNS users and/or the hearing impaired user devices owners. A device belonging to the first device group 300 or the second device group 400 can enhance the input audio based on the acquired hearing impairment information and output the enhanced audio in adaptation to the environment.

Meanwhile, the user device 100 and the devices belonging to the device groups 300 and 400 can include all the types of devices, such as information communication and multimedia devices and their equivalent equipped with hardware comprising at least one of an Application Processor (AP), a Graphic Processing Unit (GPU), and a Central Processing Unit (CPU). For example, the user device 100 can be any of a mobile phone, tablet PC, smartphone, digital camera, phablet, Portable Multimedia Player (PMP), media player, portable game console, laptop computer, Personal Digital Assistant (PDA), etc. supporting radio communication based on various types of communication protocols. In addition, the speaker-oriented hearing aid function provision method of the present invention can be applied in association with various types of display devices including but no way limited to digital TV, Digital Signage (DS), and Large Format Display (LFD).

Although the description is directed to the user device 100, a person of ordinary skill in the art should understand and appreciate that the user device represents the above-enumerated devices.

Figure 2:
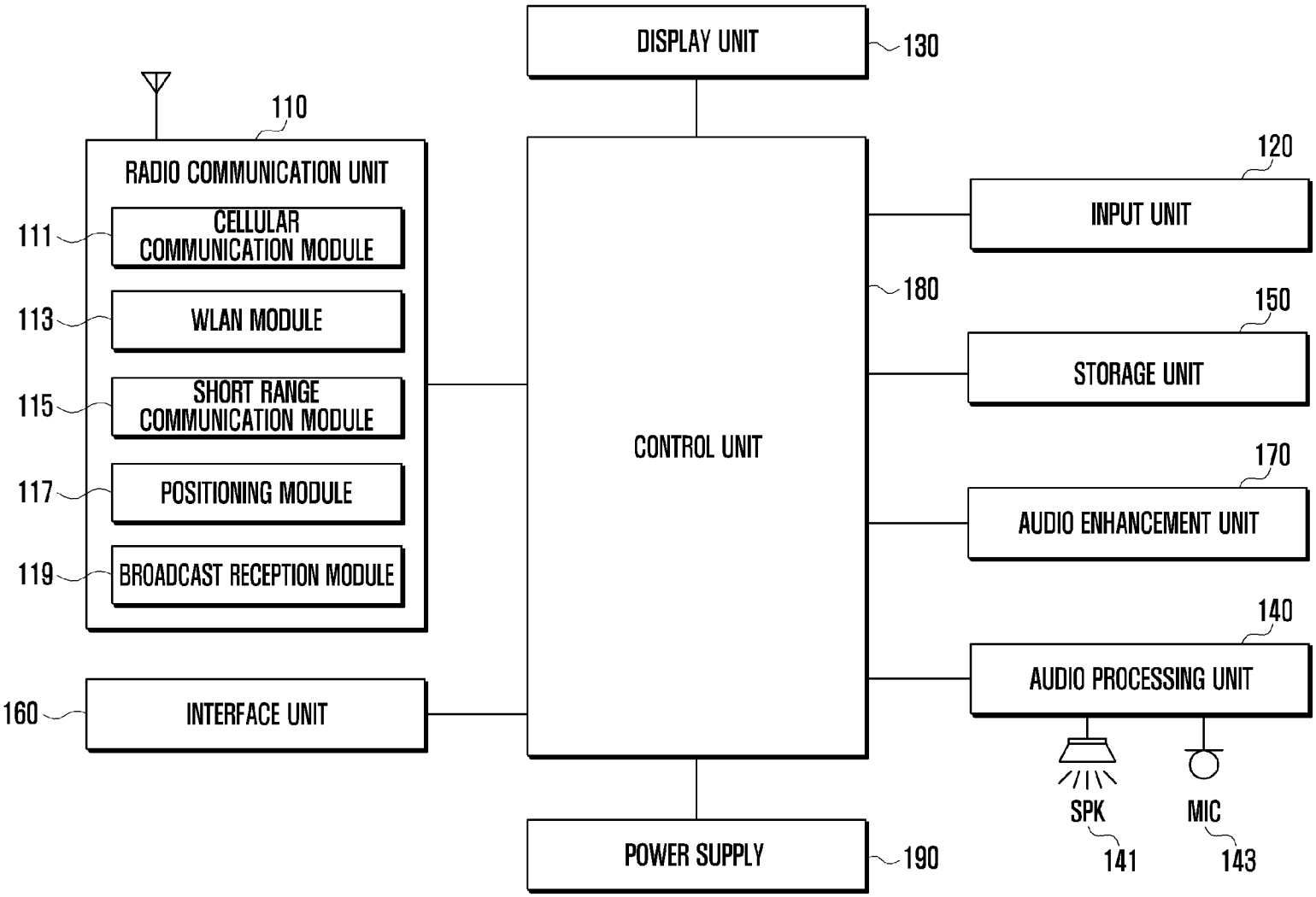
FIG. 2 is a block diagram illustrating the configuration of the user device according to an exemplary embodiment of the present invention.

FIG. 2 is a block diagram illustrating the configuration of the user device 100 according to an embodiment of the present invention.

Referring now to FIG. 2, the user device 100 preferably includes hardware such as a radio communication unit 110 comprising a transceiver, and input unit 120, a display unit 130 comprising a display screen or touch screen, an audio processing unit 140 including an audio processor/codec, a storage unit 150 comprising non-transitory machine readable medium, an interface unit 160 comprising an interface, an audio enhancement unit 170, a control unit 180 comprising hardware such as a microprocessor or processor, and a power supply 190. The components of the user device 100 that are depicted in FIG. 2 are not mandatory and thus the user device 100 can be implemented without any of those components or with any other component(s).

The radio communication unit 110 may include at least one communication module that configures a transceiver with radio communication for a radio communication system or other user devices. For example, the radio communication unit 110 may include at least one of a cellular communication module 111, a Wireless Local Area Network (WLAN) module 119, a short range communication module 115, a positioning module 117, and a broadcast reception module 119 that configure hardware.

The cellular communication module 111 transmits and receives radio signals with at least one of a base station, another device, and a server through a cellular communication network. The radio signals may carry the voice call data, video conference data, text/multimedia message, feedback information, etc. The cellular communication module 111 transmits the audio signal (e.g. voice) enhanced based on predetermined hearing impairment information (particularly, audiogram) and receives the audio signal enhanced at the other user device. The cellular communication module 111 can receive the hearing impairment information (particularly, audiogram) shared through SNS from the cloud server 200.

The WLAN module 113 configures hardware for wireless Internet access and WLAN link establishment with another user device and can be implemented in the form of an embedded or detachable module. There are various wireless Internet access technologies including WLAN (Wi-Fi), Wireless Broadband (Wibro), World Interoperability for Microwave Access (Wimax), High Speed Downlink Packet Access (HSDPA), etc. Particularly in an embodiment of the present invention, the WLAN module 113 is capable of receiving the hearing impairment information (e.g. audiogram) shared through SNS from the cloud server 200.

The short range communication module 115 is the module responsible for short range communication. There are various short range communication modules including Bluetooth, Radio Frequency Identification (RFID), Infrared Data Association (IrDA), Ultra Wideband (UWB), ZigBee, Near Field Communication (NFC), etc. A person of ordinary skill in the art should appreciate that none of the modules comprise software per se, as the claimed invention in its broadest form is statutory subject matter under 35 U.S.C. §101.

The positioning module 117 is responsible for acquiring location of the user device, and can be represented by Global Positioning System (GPS) module. The positioning module 117 includes hardware that receives information on the distances and accurate times from three or more base stations and calculates the current location in three-dimensional space with latitude, longitude, and altitude through triangulation based on the received information. The positioning module 117 can acquire the location information based on the data received from three or more satellites in real time. The location information on the user device 100 can be acquired through various methods.

The broadcast reception module 119 includes hardware to receive the broadcast signal (e.g. TV broadcast signal, radio broadcast signal, data broadcast signal, etc.) through a broadcast channel (e.g. satellite broadcast channel and terrestrial broadcast channel) and/or broadcast information (e.g. broadcast channels, broadcast programs, and/or broadcast service provider information). According to an exemplary embodiment of the present invention, when the broadcast signal is received by the broadcast reception module 119, the received broadcast signal is processed by a processor to be output through the loud speaker in the form of sound enhanced based on the user's hearing impairment information.

The input unit 120 comprises hardware that generates input data for controlling the user device 100 in response to the user's manipulation. The input unit 120 can be implemented with at least one of a key pad, a dome switch, a touch pad (resistive/capacitive), jog wheel, and jog switch.

The display unit 130 displays on the display screen the information processed by the user device 100. For example, in the voice call mode, the display unit displays a call progressing user interface or related Graphical User Interface (GUI). The display unit 130 can also display the visual image, UI, or GUI taken by a camera and/or received through the radio channel in the video conference mode or camera mode. The display unit 130 can display the guide information corresponding to the hearing impairment information of the user (e.g. speech speed and intensity).

The display unit can be embodied in a Liquid Crystal Display (LCD), thin film transistor-liquid crystal display (TFT LCD), Light Emitting Diode (LED), organic LED (OLED), Active Matrix OLED (AMOLED), flexible display, bended display, and 3-dimensional (3D) display, just to name a few non-limiting structures. Some of these display panels can be implemented in the form of a transparent or a light-transmissive display screen.

According to an exemplary embodiment of the present invention, the display unit 130 can be implemented with a layered structure of a display panel and a touch panel in the form of touchscreen integrating the display and input functionalities.

The touch panel can be implemented to convert the resistance or capacity change detected at a certain position of the display unit 130 to an electrical input signal. The touch panel also can be implemented to detect the pressure caused by a touch gesture as well as the touched position and size. If a touch gesture is detected on the touch panel, the touch panel generates the input signal(s) to a touch controller (not shown). The touch controller processes the input signal(s) to generate the corresponding data to the control unit 180. The control unit 180 is capable of determining the position where the touch gesture is made on the screen of the display unit 130.

The audio processing unit 140 transfers the audio signal from the control unit 180 to the speaker 141 or from the microphone 143 to the control unit 180. The audio processing unit 140 processes the voice/sound data to output the audible sound wave through the speaker 141 and processes the audio signal including voice received through the microphone 143 to generate a digital signal to the control unit 180. The audio processing unit includes an audio codec.

The speaker 141 provides an output of the audio data received by the radio communication unit 110 or stored in the storage unit 150 in the voice call mode, recording mode, voice recognition mode, and broadcast reception mode. The speaker 141 is outputs the sound signals generated in association with a function of the user device 100 (e.g. inbound call alarm, inbound message alarm, audio content playback, etc.). More particularly, the speaker 141 is capable of outputting audio signal input through the microphone 143 in the form of enhanced sound wave in the hearing-aid speaker mode.

The microphone 143 processes the sound input through the microphone into electrical voice data in the voice call mode, recording mode, and voice recognition mode. The processed voice data can be converted to a signal that can be transmitted to a base station by means of the cellular communication module 111. The microphone 143 can be provided with various noises cancelling algorithm for canceling the noise generated in the process of receiving outside sound.

The storage unit 150 stores machine executable code associated with the processing and control functions of the control unit 180 semi-persistently and the input/output data (including phonebook, messages, audio, still picture, electronic book, motion picture, feed information, etc.) temporarily. These data can be stored in the storage unit 150 along with usage frequency (e.g. usage frequency of contact, message, multimedia content, feed information, etc.) and importance. The storage unit 150 can store various types of vibration patterns and sound effects data output in association with the touch gesture made on the touchscreen. Particularly in an exemplary embodiment of the present invention, the storage unit 150 stores the per-user hearing impairment information received by means of the radio communication unit 110. For example, the storage unit 150 stores the hearing impairment information(s) of plural hearing-impaired users in the form of an hearing-impairment information table as shown in Table 1. An artisan can understand an appreciation that the use of a hearing impairment information table as shown in Table 1 is but one example of how the information can be arranged in storage, In this example, the hearing-impairment information is stored in the state of being mapped with the contact information (or identity information). The storage unit 150 can store various setting information related to the hearing-aid mode operation. The setting information may include operation mode information and per-mode operation information (e.g. audio output path and environment-adaptive audio output mode).

The storage unit 150 can include at least one of storage media including flash memory, hard disk, micro card memory (e.g. SD and XD cards), Random Access Memory (RAM), Static RAM (SRAM), Read-Only Memory (ROM), Electrically Erasable Programmable ROM (EEPROM), Programmable ROM (PROM), Magnetic RAM (MRAM), magnetic disk, and optical disk. In all cases, the storage unit is a non-transitory memory as the claimed invention under its broadest reasonable interpretation constitutes statutory subject matter. The user device 100 is operable in association with web storage operating on Internet in the same manner as the storage unit 150.

The interface unit 160 is responsible for connection of the user device 100 with other external devices. The interface unit 160 is of provides a connection for receiving data from an external device, charging the user device 100, and transmitting data generated by the user device 100 to the external device. For example, the interface unit 160 comprises hardware including wired/wireless headset port, charging port, wired/wireless data port, memory card slot, identity module device connection port, audio Input/Output (I/O) port, video I/O port, earphone jack, just to name a few non-limiting possibilities.

The audio enhancement unit 170 comprises hardware that enhances the audio input in the hearing-aid mode under the control of the control unit 180. Particularly in an exemplary embodiment of the present invention, the audio enhancement unit 170 processes the input audio based on the hearing impairment information (especially audiogram) to output enhanced audio that is compensated in some degree based on the audiogram information. At this time, the audio enhanced by the audio enhancement unit 170 is output through the output path (e.g. speaker path or communication path) determined according to the configuration of the control unit 180. The audio enhancement function of the audio enhancement unit 170 can be integrated into the control unit 180 or embedded in the control unit 180. The detailed audio processing operation of the audio enhancement unit 170 will be more described in additional detail in the following description with reference to operation and processing examples.

The control unit 180, which comprises hardware such as a microprocessor or processor, controls overall operations of the user device 100. For example, the control unit 180 controls the voice call processing, data communication, video conferencing, etc. The control unit 180 can include a multimedia module for playback of multimedia contents. The multimedia module can be integrated into the control unit 180 or arranged as a separate component. Particularly in an exemplary embodiment of the present invention, the control unit 180 controls receiving the hearing impairment information input by the user and transmitting the hearing impairment information to the cloud server 200 to share the hearing impairment information with others through SNS. The control unit 180 also controls the operations associated with collecting the per-user hearing-impairment information shared through SNS and enhancing the audio signal based on the hearing-impairment information. The control unit 180 can be configured to differentiate among the hearing aid modes, i.e. hearing aid speaker mode and hearing aid communication mode and controlling the audio enhancement operations depending on the hearing aid mode. The detailed control operations of the control unit 180 will be discussed in more detail the following description with the exemplary operations and procedures of the user device.

The power supply 190 supplies the power from the internal or external power source to the components of the user device 100.

The above exemplary embodiments of the present invention can be implemented by Application Specific Integrated Circuits (ASICs), Digital Signal Processors (DSPs), Digital Signal Processing Devices (DSPDs), Programmable Logic Devices (PLDs), Field Programmable Gate Arrays (FPGAs), a processor, a controller, a microcontroller, or a microprocessor, etc. In any case, the disclosed embodiments can be implemented on the control unit 180.

Figure 3:
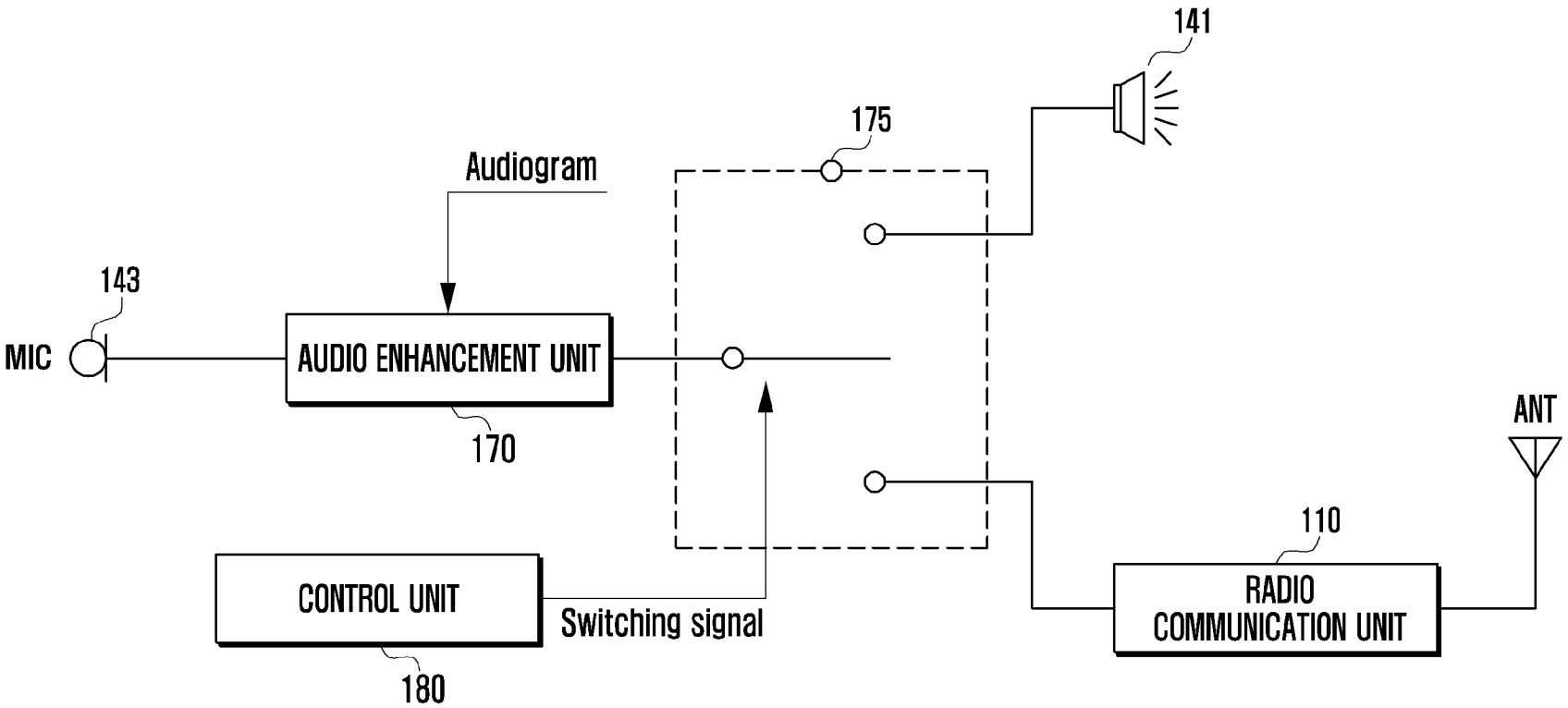
FIG. 3 is a schematic diagram illustrating the mechanism of the speaker-oriented hearing aid function of the user device according to an exemplary embodiment of the present invention.

FIG. 3 is a schematic diagram illustrating the mechanism of the speaker-oriented hearing aid function of the user device according to an exemplary embodiment of the present invention.

Referring now to FIG. 3, the speech of the user is input through the microphone 143 of the user device in the face-to-face conversation or telephone conversation situation. At this time, the control unit 180 determines whether to activate the hearing aid mode and, in the hearing aid mode, whether to operate in the hearing aid speaker mode or a hearing aid communication mode. The determination as whether to activate the hearing aid mode can be by a changeable default, in response to the user request, or based on the per-user hearing impairment information. Once the hearing mode has been determined, the control unit 180 generates a switching signal to the switch 175. In other words, the control unit 180 can generate the switching signal for switching the voice path to the speaker for the hearing aid speaker mode or to the radio communication unit for the hearing aid communication mode.

The switch 175 operates to switch the audio (e.g. voice) enhanced by the audio enhancement unit 170 between the voice paths to the speaker 141 and the radio communication unit 110. The switch 175 can be implemented in the control unit 180 or by software loaded into hardware.

The audio input through the microphone 143 is digitally processed to output the voice signal to the hearing enhancement unit 170. The microphone 143 can be provided with a noise cancelling algorithm to remove the noise from the voice signal.

The audio enhancement unit 170 enhances the voice signal to generate the enhanced voice signal based on the hearing impairment information stored in the storage unit 150. The hearing enhancement unit 170 can output the enhanced voice signal through the audio path determined according to the switching signal indicating the hearing aid mode of the control unit 180.

In the hearing aid speaker mode, the control unit 180 generates a switching signal to the switch 175 to switch the voice path to the speaker 141. In this exemplary case, the audio enhancement unit 170 transfers the enhanced voice signal through the voice path to the speaker 141. The speaker outputs the enhanced voice signal from the audio enhancement unit 170 in the form of an audible sound wave.

In the hearing aid communication mode, the control unit 180 generates a switching signal to the switch 175 in order to switch the voice path to the radio communication unit 110. In this case, the audio enhancement unit 170 transfers the enhanced voice signal through the audio path to the radio communication unit 110 (particularly, cellular communication module 111). The radio communication unit 110 converts the enhanced voice signal to a radio signal according to a radio communication protocol and transmits the radio signal through an antenna.

Figure 4:
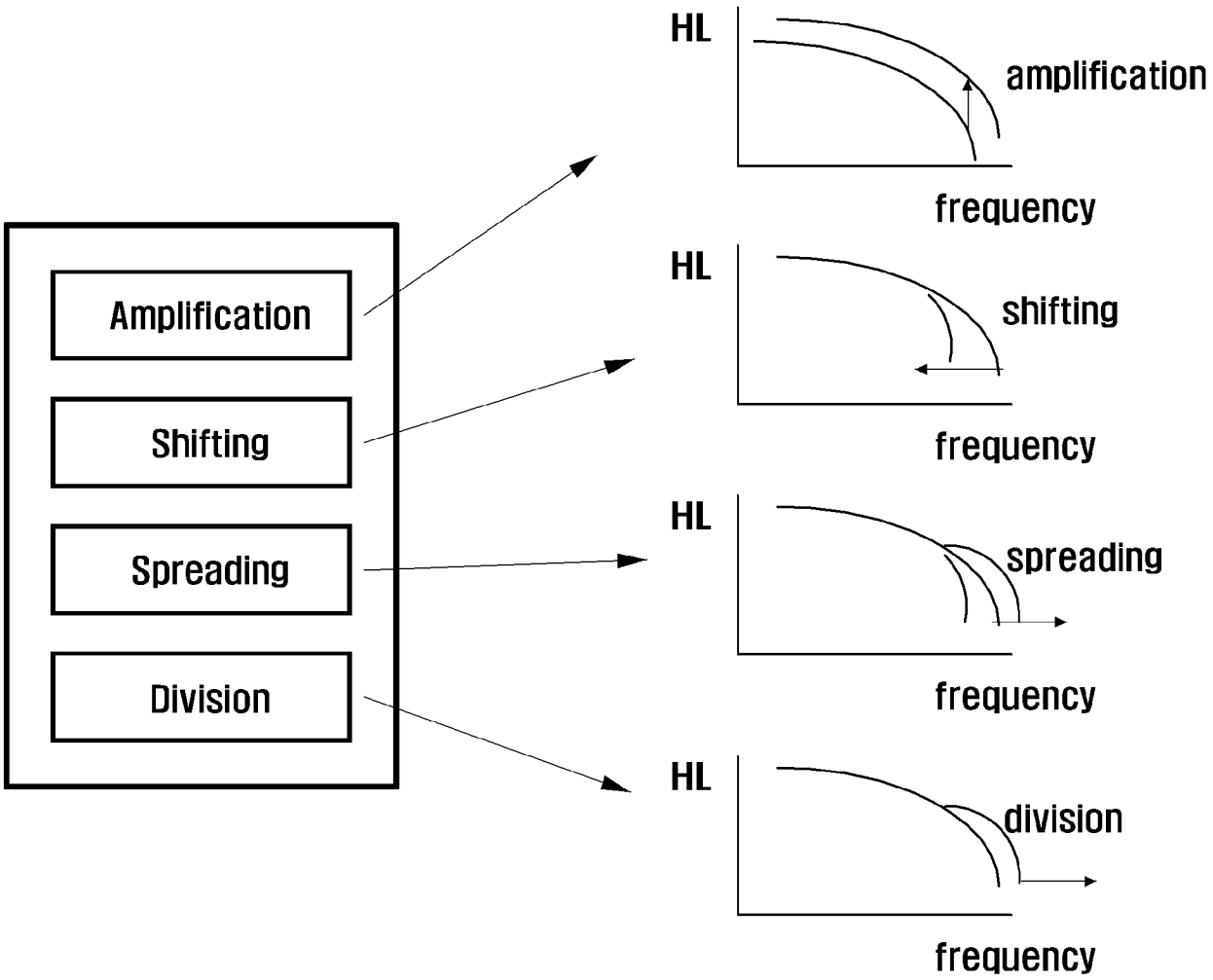
FIG. 4 is a diagram illustrating the principle of enhancing the voice signal in the user device according to an exemplary embodiment of the present invention.

FIG. 4 is a diagram illustrating the principle of enhancing the voice signal in the user device according to an exemplary embodiment of the present invention.

Referring now to FIG. 4, the input audio can be enhanced through amplification, shifting, spreading, and division performed on the basis of the hearing-impairment information. More particularly, the hearing aid function provision method of the present invention in this example enhances the voice signal by performing at least one of the amplification, shifting, spreading, and division processes or a combination of them. The amplification, shifting, spreading, and division processes can be performed in a predetermined sequence. Also, it is possible to perform the amplification, shifting, spreading, and division processes in a random sequence, or performance of just one, two, or three of the items.

For example, the audio enhancement unit 170 is configured for at least one, but preferably all of amplifying, shifting, spreading, and dividing. In other words, the audio enhancement unit can spread the input audio based on the hearing impairment information according to an audio enhancement scheme to output the enhanced audio signal. The audio enhancement unit 170 can also be configured for spreading and dividing the input audio based on the hearing impairment information to output the enhanced audio signal. The audio enhancement unit 170 can also be configured for amplifying, shifting, spreading, dividing, and dividing the input audio sequentially or simultaneously based on the hearing impairment information to output the enhanced audio signal.

In the case of audio enhancement with amplification process, the audio enhancement unit 170 amplifies the frequency band and intensity of the audio signal to the extent corresponding to the audible level for the hearing of a person in the normal range based on the hearing impairment information. In the case of audio enhancement with shifting process, the audio enhancement unit 170 shifts the frequency band and intensity of the audio signal to the extent corresponding to the audible level for the normal person based on the hearing impairment information. In the case of audio enhancement with spreading process, the audio enhancement unit 170 applies the frequency band and intensity in addition to the frequency band and intensity of the input audio signal based on the hearing impairment information. Here, the spreading-based audio enhancement is appropriate for the case where the user's hearing-impairment is significant on the basis of the hearing impairment information. In the case of audio enhancement with division process, the audio enhancement unit 170 divides the frequency band and intensity of the audio signal to the extent corresponding to the audible level for the normal person based on the hearing impairment information.

Figure 5:
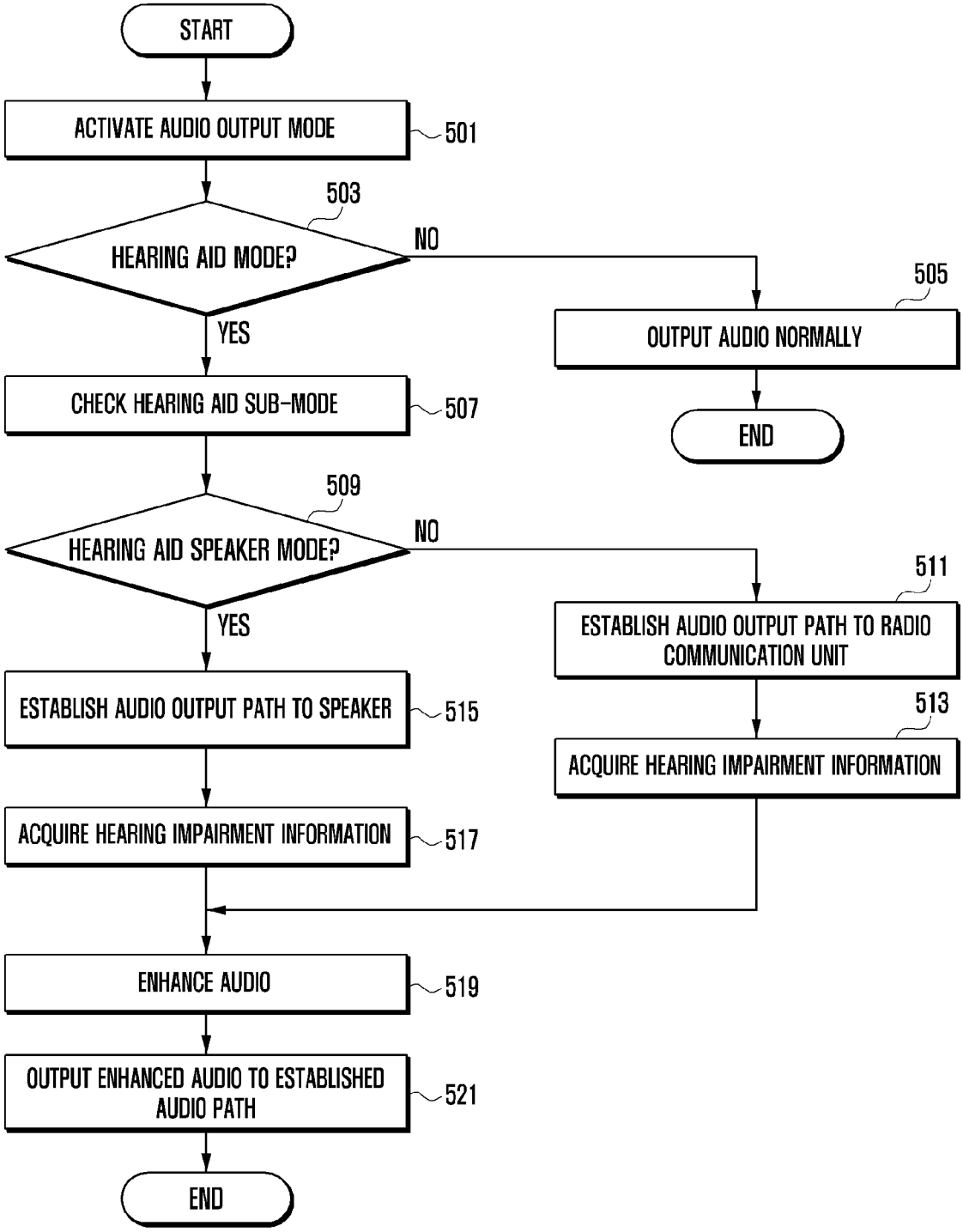
FIG. 5 is a flowchart illustrating exemplary operation of the hearing aid method of the user device according to an exemplary embodiment of the present invention.

FIG. 5 is a flowchart illustrating exemplary operation of a hearing aid method of the user device according to an exemplary embodiment of the present invention.

Referring now to FIG. 5, at step 501, when the audio output mode is activated, then at step 503 the control unit 180 determines whether or not the hearing aid mode has been activated (or is activated). In the present invention, the audio output mode is activated by the inbound or outbound voice or video call or execution of an audio output function such as music playback and motion picture playback.

At step 503, if the hearing aid mode has not been activated, i.e. if the user device is operating in the normal audio output mode, then at step 505 the control unit 180 controls such that the audio is processed in the normal audio output mode. For example, the input audio is processed so as to be output through the audio path (to speaker or radio communication unit) determined without audio enhancement process.

At step 503, if the hearing aid mode has been activated, then at step 507 the control unit 180 checks the hearing aid mode execution type.

At step 509, the control unit 180 determines whether the hearing aid mode is the hearing aid speaker mode. In an exemplary embodiment of the present invention, the hearing aid speaker mode is the operation mode in which the audio input through the microphone 143 or played in the user device is enhanced and then output through the speaker 141 of the user device, while the hearing aid communication mode is the operation mode in which the audio input through the microphone 143 is enhanced and then output through the radio communication unit 110 (particularly the cellular communication unit 111). The hearing aid mode can be preconfigured or configured by the user right before the audio output mode is activated.

At step 511, in the case where at step 509 the control unit 180 determines that the hearing aid mode is not the hearing aid speaker mode, i.e. when the current hearing aid mode is the hearing aid communication mode, and the control unit 180 establishes the audio output path for radio communication. In other words, the control unit 180 controls such that the audio signal (e.g. voice) input through the microphone 143 is enhanced (such as described hereinabove by the audio enhancement unit 170) and then output through the audio path to the radio communication unit 110 (particularly, the cellular communication module 111).

After establishing the audio path at step 511, then at step 513 the control unit 180 acquires the hearing impairment information to be referenced for enhancing the audio according to the hearing aid communication mode. More particularly, the control unit 180 extracts the contact information on the counterpart user in the communication mode (outbound or inbound) and acquires the hearing impairment information mapped to the contact information. If there is no hearing impairment information (particularly, audiogram) mapped to the contact information, the control unit 180 can then acquire the hearing impairment (particularly, audiogram) of the counterpart user from an SNS database. The SNS-based hearing impairment information acquisition in the outbound call mode can be performed in process of the recall request fed back by the network as described later. Once the hearing impairment information on the counterpart user has been acquired, then step 519 is performed.

At step 515, when it was determined at step 509 the hearing aid mode is the hearing aid speaker mode, the control unit 180 establishes the audio output path to the speaker. In other words, the control unit 180 controls such that the audio signal (e.g. voice) input through the microphone 143 or output by playback of an audio file is enhanced and then output through the audio path to the speaker 141.

At step 517, the control unit 180 acquires the hearing impairment information to be referenced for enhancing the audio according to the hearing aid speaker mode. Particularly, the control unit 180 is capable of acquiring the hearing impairment information on the face-to-face counterpart (e.g. device user or counterpart user in the face-to-face conversation) for use in the hearing aid speaker mode. Once the hearing impairment information has been acquired, then step 519 is performed.

At step 519, after acquiring the hearing impairment information according to the operation mode, the control unit 180 enhances the input (received) audio based on the acquired hearing impairment information.

Next, at step 521 the control unit 180 outputs the enhanced audio to through the audio path determined according to the hearing aid mode. For example, if the audio path is switched to the speaker 141, the control unit 180 controls such that the enhanced audio is output through the speaker 141; and otherwise if the audio path is switched to the radio communication unit 110, the control unit 180 controls such that the enhanced audio is transmitted over radio channel by means of the radio communication unit 110 (particularly, a transceiver associated with the cellular communication module 111). When the audio path is switched to the speaker 141, the control unit 180 controls the audio enhancement unit 170 to process the audio signal (e.g. analog signal conversion, amplification, etc.) such that the enhanced audio signal is output through the speaker 141. When the audio path is switched to the radio communication unit 110, the control unit 180 controls the audio enhancement unit 170 to process the audio signal (e.g. encoding, modulation, RF conversion, etc.) such that the enhanced audio signal is transmitted over radio channel by means of the radio communication unit 110.

Figure 6:
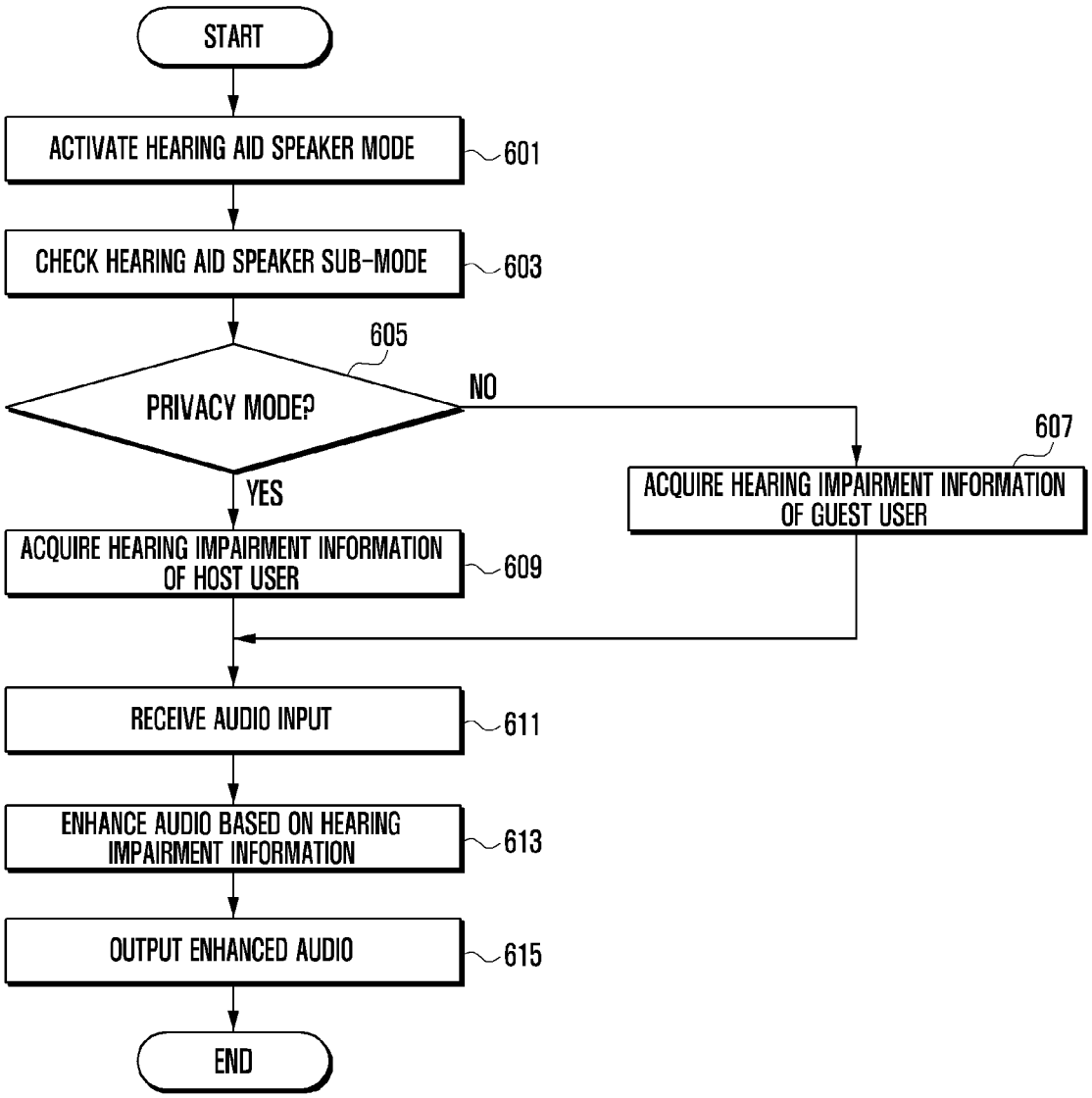
FIG. 6 is a flowchart illustrating exemplary operation of the hearing aid method of the user device according to another exemplary embodiment of the present invention.

FIG. 6 is a flowchart illustrating exemplary operation of the hearing aid method of the user device according to another exemplary embodiment of the present invention. Particularly, FIG. 6 is directed to the case where the user device 100 according to an exemplary embodiment of the present invention operates in the hearing aid speaker mode with the activation of the audio output mode.

Referring now to FIG. 6, at step 601 the hearing aid speaker mode is activated.

At step 603, the control unit 180 checks the sub-mode of the hearing aid speaker mode and then at step 605 determines whether or not the hearing aid speaker mode is a privacy mode (or the public mode or loud speaker mode). The public mode is the operation mode of outputting the audio (e.g. voice or internally generated audio) enhanced based on the hearing impairment information of the face-to-face counterpart, and the privacy mode is the operation mode of outputting the audio enhanced based on the hearing impaired user using the user device.

At step 605, if the hearing aid speaker mode is not the privacy mode, i.e. if the hearing aid speaker mode is the public mode, then at step 607 the control unit 180 acquires the hearing impairment information for use in enhancing the audio according to the public mode. More particularly, the control unit 180 can acquire the hearing impairment information on the face-to-face counterpart. In the public mode, the hearing impairment information can be acquired in response to the user manipulation or by referencing the hearing impairment mapped to the contact information on the device of the face-to-face counterpart identified through SNS or an alternative source. Once the hearing impairment information on the face-to-face counterpart has been acquired, then step 611 is performed.

However, when at step 605 the hearing aid speaker mode is determined to be in the privacy mode, then at step 609 the control unit 180 acquires the hearing impairment information for enhancing the audio according to the privacy mode. Particularly, the control unit 180 can acquire the hearing impairment information of the device user. In the privacy mode, the hearing impairment information can be acquired based on the predetermined hearing impairment information set by the user. Once the hearing impairment information on the face-to-face counterpart has been acquired, then step 611 is performed.

At step 613, after acquiring the hearing impairment information according to the current hearing aid speaker sub-mode at step 611, the control unit 180 enhances the audio (e.g. user's voice or the counterpart's voice) based on the acquired hearing impairment information. Finally, at step 615 the control unit 180 outputs the enhanced audio through the preset audio path to the speaker.

Figure 7:
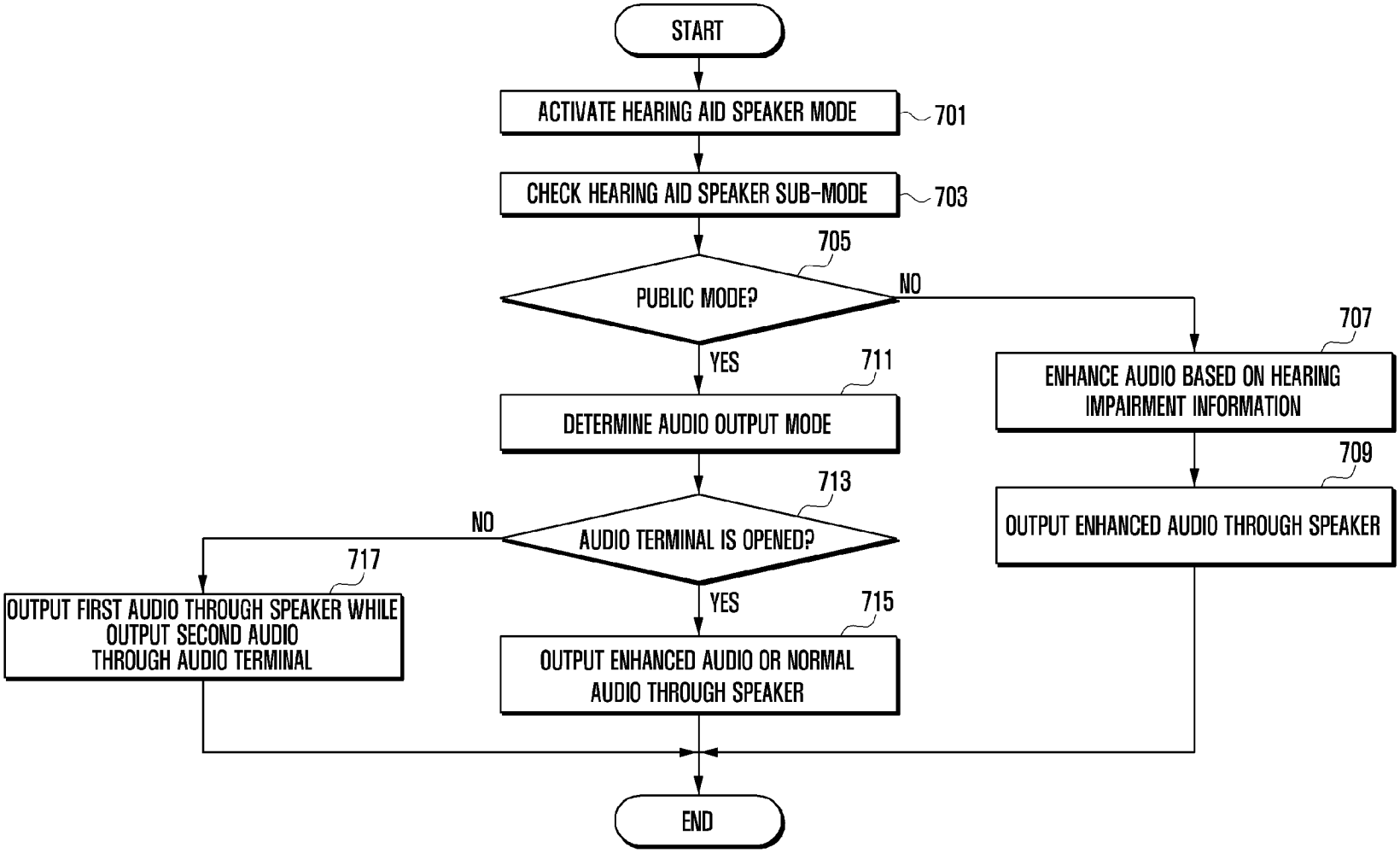
FIG. 7 is a flowchart illustrating exemplary operation of the hearing aid method of the user device according to another exemplary embodiment of the present invention.

FIG. 7 is a flowchart illustrating an exemplary operation of the hearing aid method of the user device according to another exemplary embodiment of the present invention. More particularly, FIG. 7 is directed to the case where the user device 100 according to an exemplary embodiment of the present invention operates in the hearing aid speaker mode with the activation of the audio output mode.

Referring now to FIG. 7, at step 701 the hearing aid speaker mode is activated.

At step 703, the control unit 180 checks the sub-mode of the hearing aid speaker mode.

At step 705, the control unit determines whether the hearing aid speaker mode is a public mode (or the privacy mode). The public mode is the operation mode in which the audio output is set for the hearing impaired user or other user and which is useful in the situation where the hearing impaired user and others (normal users and/or other hearing impaired users) operate the user device together (e.g. they are watching TV together) in the same space (e.g. home, office, etc.). In this mode, the audio output can be set by the user. The privacy mode is the operation mode in which the audio output is user-oriented and which is useful in the situation where the hearing impaired user uses the user device alone (e.g. watching TV alone at home).

At step 705, the hearing aid speaker mode is not the public mode, i.e. when the hearing aid speaker mode is the privacy mode, then at step 707 the control unit 180 enhances the audio based on the hearing impairment information on the device user.

At step 709 the control unit controls output of the enhanced audio through the speaker 141. In the privacy mode, the user device enhances the audio based on the hearing impairment information and outputs the enhanced audio in a situation where the hearing impaired user is using the device (e.g. watching TV) alone.

At step 705, it is determined that the hearing aid speaker mode is the public mode, then at step 711 the control unit 180 determines the audio output mode, i.e. host-oriented audio output mode or guest-oriented audio output mode.

For example, when the hearing impaired user and others (normal users and/or other hearing impaired users) operate the user device together (e.g. watch TV together), the user may configure the user device to output the audio enhanced based on the user's hearing impairment information or the audio enhanced based on the other user's hearing impairment information through the speaker 141.

At step 713, after checking (determining) the audio output mode, the control unit 180 determines whether the audio output terminal (e.g. earphone jack) is opened at step 713. For example, the control unit 180 can detect attachment or detachment of an earphone (not shown) according to various connection detection methods.

At step 713, if the audio output terminal is opened, i.e. if no earphone is connected to the earphone jack, then at step 715 the control unit 180 outputs the enhanced or normal audio through the speaker 141 according to the audio output mode (e.g. host-oriented or guest-oriented audio output mode. In the case of the host-oriented audio output mode, the control unit 180 outputs the audio enhanced based on the hearing impairment information on the user through the speaker. In the case of the guest-oriented audio output mode, the control unit 180 outputs the normal audio or the audio enhanced based on the hearing impairment information on a guest user through the speaker 141.

At step 713, if the audio output terminal is not opened, i.e. if an earphone is connected to the earphone jack, then at step 717 the control unit 180 outputs a first audio through the speaker 141 according to the determined audio output mode (i.e. host-oriented or guest-oriented audio output mode) and outputs a second audio through an audio terminal (not shown). Here, if the first audio is the audio enhanced based on the hearing impairment information of the host hearing impaired user, the second audio can be the normal audio or the audio enhanced based on the hearing impairment information of a guest hearing impaired user. In contrast, if the first audio is the normal audio or the audio enhanced based on the hearing impairment information of a guest hearing impaired user, the second audio can be the audio enhanced based on the hearing impairment information of the host hearing impaired user.

For example, in the host-oriented audio output mode, the control unit 180 can control output of the audio enhanced based on the host users' hearing impairment information through the speaker while outputting the normal audio or the audio enhanced based on a guest user's hearing impairment information. In the guest-oriented audio output mode, the control unit 180 is capable of outputting the normal audio or the audio enhanced based on the guest user's hearing impairment information while outputting the audio enhanced based on the host user's hearing impairment information through the audio terminal.

Although neither depicted in FIG. 7 nor described, when the user is not hearing-impaired, it is also possible to operate the user device as configured to operate in the host-oriented or guest-oriented audio output mode.

Figure 8:
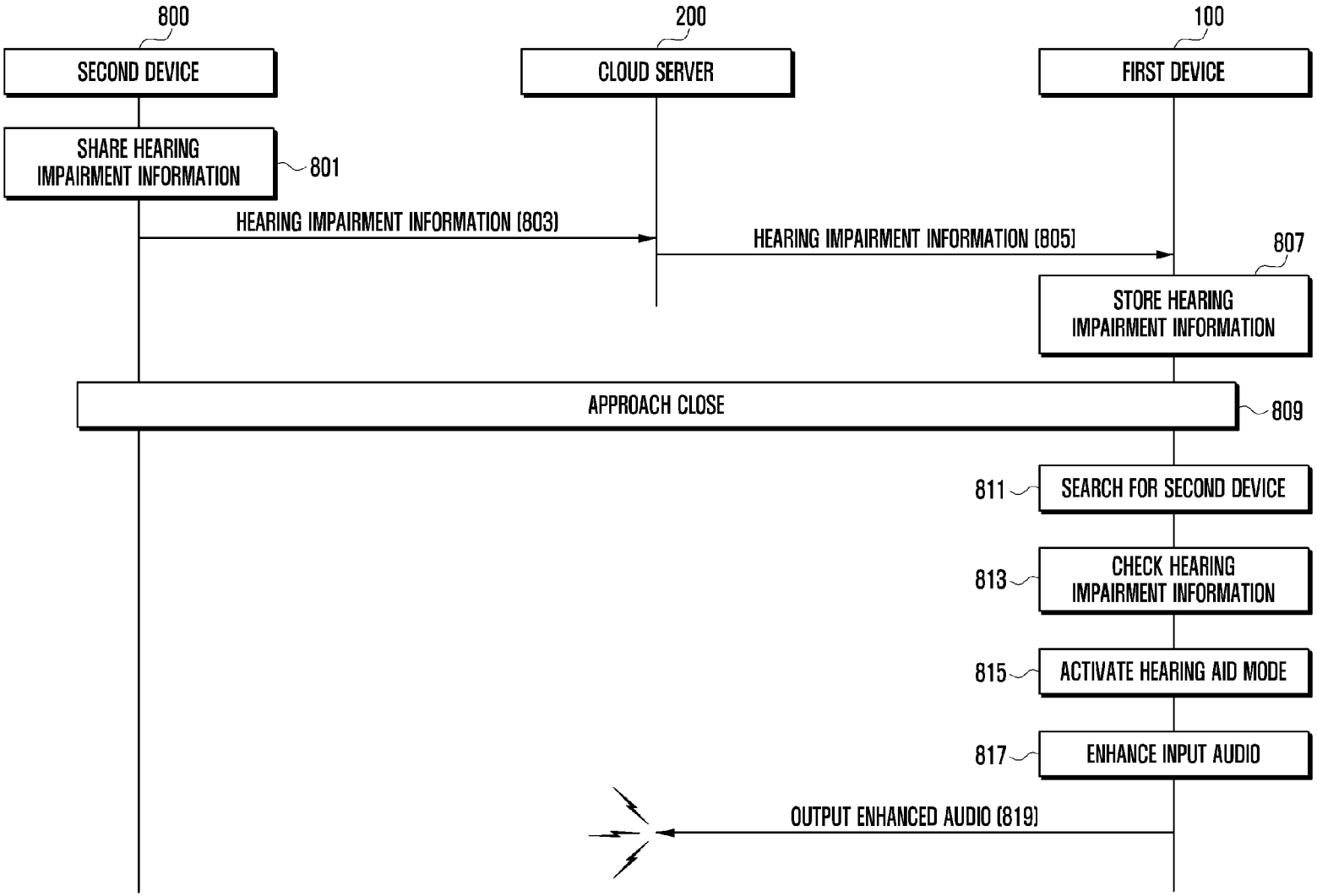
FIG. 8 is a signal flow diagram illustrating the hearing aid function provision method of the user device according to an exemplary embodiment of the present invention.

FIG. 8 is a signal flow diagram illustrating the hearing aid function provision method of the user device according to an exemplary embodiment of the present invention.

More particularly, FIG. 8 is directed to the exemplary case where, if the host user enters a predetermined range around a hearing-impaired user, the host user device recognizes the hearing-impaired user device to activate the hearing-aid mode automatically. In FIG. 8, it is assumed that the second device 800 is of the second (hearing-impaired) user and the first device 100 is of the first user which checks the shared hearing impairment information on the second user and executes the hearing-aid mode automatically.

Referring again to FIG. 8, at step 801 the second device 800 detects the hearing impairment information sharing request input by the second user.

At step 803, the second device 800 sends the hearing impairment information of the second user to the cloud server 200 to share the information with others. The hearing impairment information of the second user can be shared with at least one group (e.g. friends, family, coworkers, etc.) in a specific relationship or public users on SNS.

At step 805, the first device 100 acquires the second user's hearing impairment information registered with the cloud server 200.

At step 807, the first device 100 stores the acquired second user's hearing impairment information. The first device 100 can store the device identity information and contact information of the second device 800 in the state of being mapped with the second user's hearing impairment information.

At step 809, in the state that the second user's hearing impairment information has been shared, the first and second devices 100 and 800 may approach to be in a predetermined distance range.

At step 811, in the case where the first device 100 discovers the second device 800, the search for the first device search may be triggered by the request of the first user. The first device 100 can be configured to perform device search automatically when it is detected that the first and second devices 100 and 800 are located in the same area with the assistance of a location-based service.

At step 813, if the second device 800 is found, the first device 100 checks the second user's hearing impairment information based on the second device information (e.g. device identity information or contact information).

At step 815, in the state of being "close" to the second device 800, the first device 100 activates the hearing aid mode based on the checked second user's hearing impairment information. As described above, the first device 100 can activate the hearing aid speaker mode.

At step 817, the first device 100 operating in the hearing aid mode enhances the audio input through the microphone 143 based on the second user's hearing impairment information.

At step 819 and outputs the enhanced audio through the speaker 141. For example, the first user is capable of inputting voice addressed to the second user through the microphone 143 of the first device. If the first user's voice is input, the first device 100 enhances the input voice based on the second user's hearing impairment information and outputs the enhanced voice through the speaker 141. In this way, the first and second users can have a conversation smoothly.

Although neither depicted in FIG. 8 nor described, the first device 100 can output a guide message according to the second user's hearing impairment information.

For example, the hearing impairment may be caused by speech speed as well as frequency. The first user as the speaker has to speak slowly enough for the second user as a hearing impaired to follow, and the tolerable speech speed varies depending on the second user's hearing impairment level. Accordingly, the first device 100 can be configured to provide guidance on the speech speed and intensity through a certain UI or GUI on the screen of the display unit 130. The first user can follow the guidance presented on the screen of the display unit 130 for smooth conversation.

Figure 9:
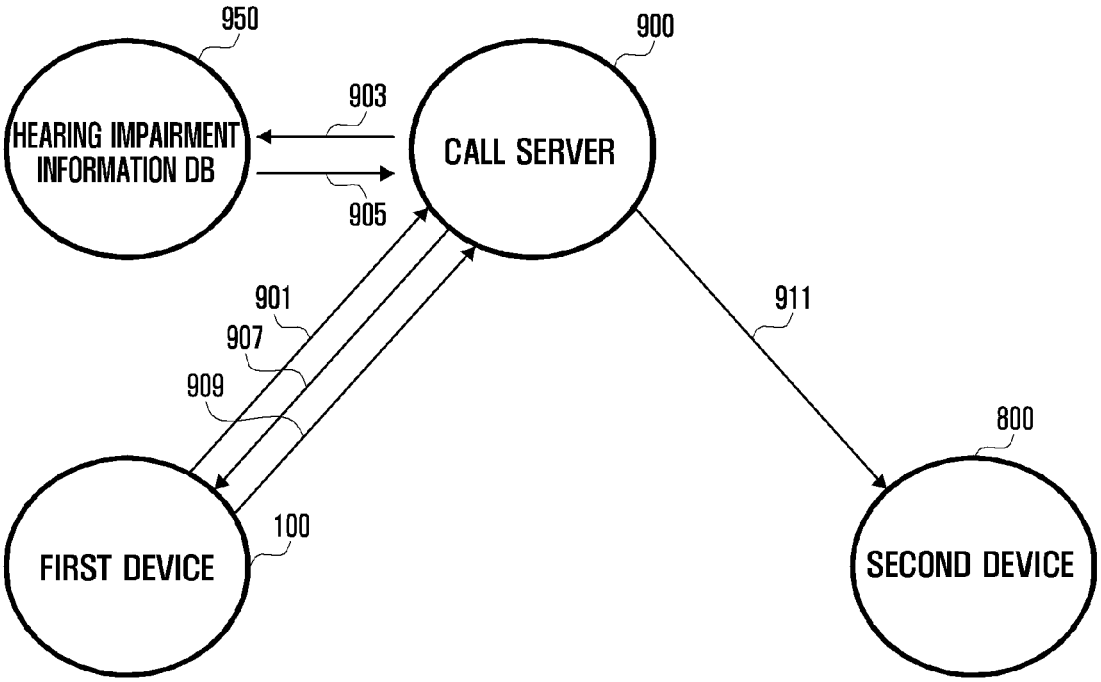
FIG. 9 is a diagram illustrating the operation mechanism of the hearing-aid system according to an exemplary embodiment of the present invention.

FIG. 9 is a diagram illustrating the operation mechanism of the hearing-aid system according to an exemplary embodiment of the present invention.

Referring now to FIG. 9, the first device 100 places a call in response to the request of the first user as denoted by reference number 901. For example, the first user enters the recipient information (contact information) of second device 800 and presses "send" button, the first device 100 sends a call setup request to the call server 900 (e.g. base station) for call setup with the second device 800 identified by the recipient information.

If the call setup request is received from the first device 100, the call server 900 looks up the hearing impairment information DB 950 for the hearing impairment information mapped to the recipient information, i.e. the second device 800 as denoted by reference number 903. The hearing impairment BD 950 can be, for example, a DB of the call server 900 or a DB of a cloud server 200 interoperating through SNS. In response to the call setup request, the call server 900 can look up the hearing impairment DB for the recipient information. If the recipient information is retrieved from the hearing impairment DB as denoted by reference number 905, the call server sends the first device 100 a feedback informing of the hearing impairment of the user of the second device 800 and requesting the first user to retransmit the call setup request in the hearing aid mode as denoted by reference number 907. If the recipient information is not retrieved from the hearing impairment information DB 950, the call server 900 delivers the call setup request to the second device 800 as addressed by the recipient information through the normal procedure.

With continued reference to FIG. 9, if the feedback requesting for retransmission of the call setup request from the call server 900, the first device 100 executes a hearing aid mode based on the hearing impairment information (particularly, audiogram) and transmits the call setup request automatically as denoted by reference number 909. At this time, the first device 100 can transmit the call setup request along with the information indicating the call setup request triggered in the hearing aid mode. If the call setup request is received from the first device 100, the call server 900 delivers the call setup request to the second device 800 corresponding to the recipient information as denoted by reference number 911. If the call setup is established between the first and second devices 100 and 800, the first device 100 enhances the first user's voice input through the microphone 143 based on the hearing impairment information (particularly, audiogram of the second user) and sends the second device 800 the enhanced voice by means of the radio communication unit 100.

As described above, if a call set request is received from the sending device, the call server 900 looks up the DB to determine whether the recipient is hearing-impaired and, if so, guides the sending device to transmit the call setup request based on the hearing impairment information of the recipient device user. In other words, the call server 900 can transmit a feedback request for retransmission of the call setup request placed in hearing aid mode.

Figure 10:
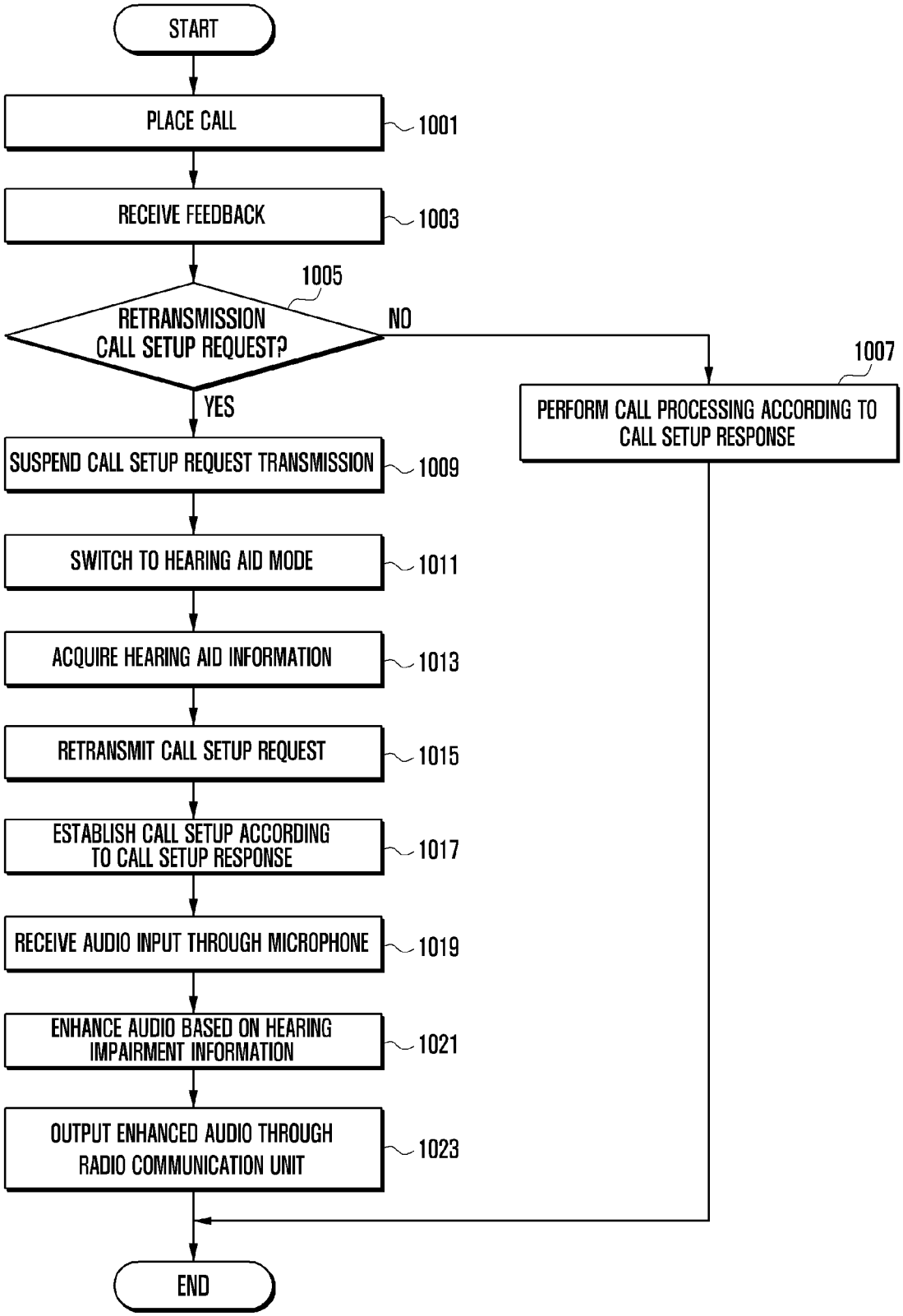
FIG. 10 is a flowchart illustrating exemplary operation of the hearing aid method of the user device according to an exemplary embodiment of the present invention.

FIG. 10 is a flowchart illustrating exemplary operation of the hearing aid method of the user device according to an exemplary embodiment of the present invention. More particularly, FIG. 10 is directed to the case where the user device 100 operates after switching to the hearing aid mode in response to the feedback instructing retransmission of the call setup request from the call server 900.

Referring now to FIG. 10, at step 1001 the control unit 180 places a call in response to the request of the user. For example, if the user enters the recipient information and presses a button designated for placing a call, the control unit 180 sends the call server 900 a call setup request for call setup with the recipient user device.

At step 1003, if a feedback is received from the call server 900 in response to the call setup request, then at step 1005 the control unit 180 determines whether the feedback recommends retransmission of the call setup request. In other words, if the feedback is received from the call server 900 in response to the call setup request, the control unit 180 determines whether the feedback is a hearing aid mode call setup request retransmission instruction or a normal call setup response.

At step 1005, if the feedback is the normal call setup response, then at step 1007 the control unit 180 establishes the call setup with the recipient user device through the normal call setup procedure.

Otherwise, if the feedback is the hearing aid mode call setup request retransmission instruction, then at step 1009 the call setup request transmission is suspended.

At step 1011, the control unit 180 controls switching to hearing id mode.

At step 1013, the control unit 180 acquires the hearing aid (impairment) information on the recipient device user from the feedback message.

Upon receipt of the hearing impairment information (particularly, audiogram), then at step 1015, the control unit 180 retransmits the call set request with the recipient information. At this time, the control unit 180 can transmit the call setup request including the indication informing the call server 900 of the call setup request retransmitted in the hearing aid mode.

At step 1017, the control unit 180 establishes a call setup with the recipient device upon receipt of a call setup response.

After the call setup establishment with the recipient device, then at step 1019 if audio (i.e. user's voice) is input through the microphone 143.

At step 1021, the control unit 180 enhances the audio based on the acquired hearing impairment information (particularly, audiogram).

At step 1023, the control unit 180 sends the recipient device the enhanced audio by means of the audio communication unit 110.

Figure 11:
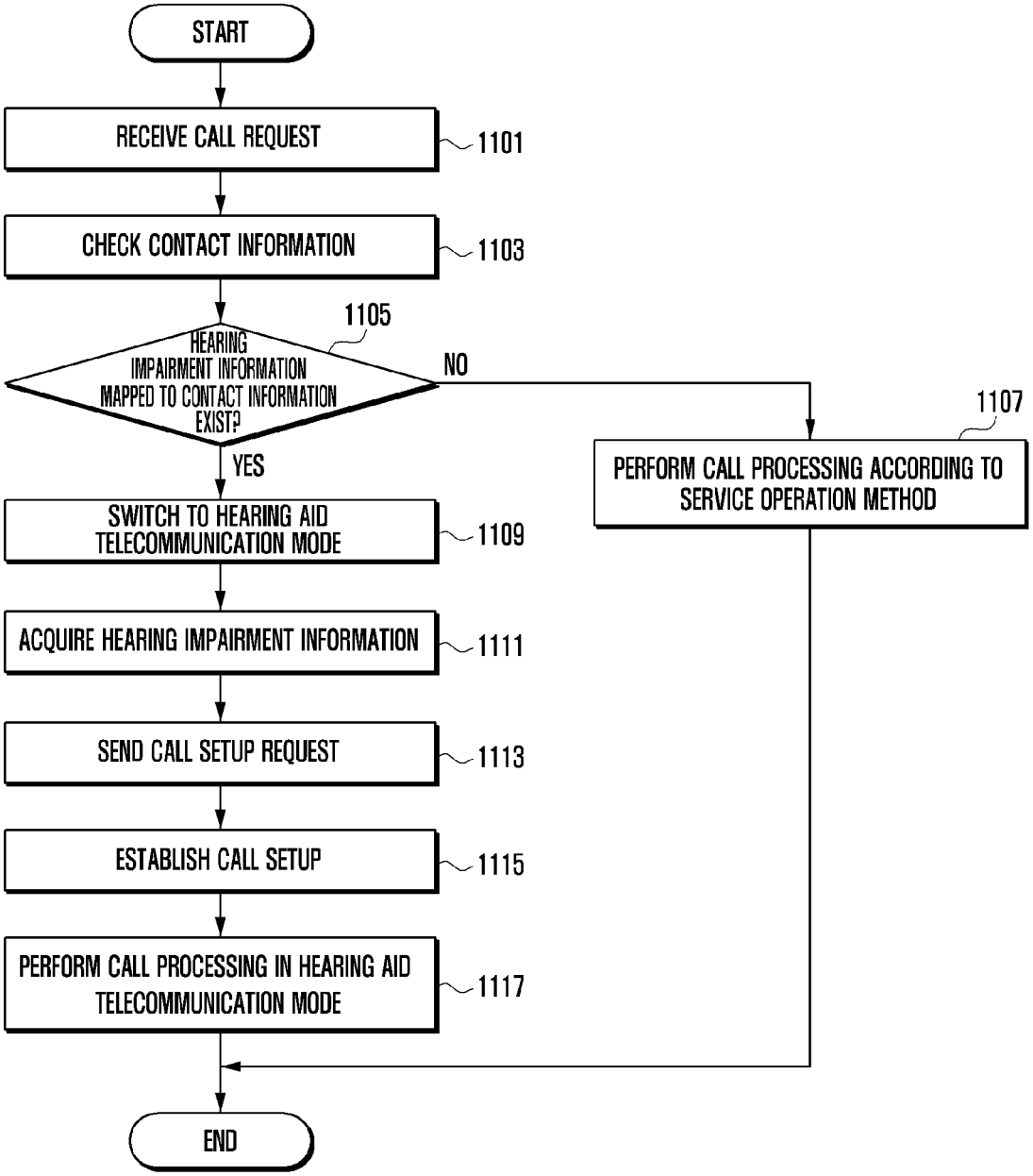
FIG. 11 is a flowchart illustrating exemplary operation of the hearing aid method of the user device according to another exemplary embodiment of the present invention.

FIG. 11 is a flowchart illustrating exemplary operation of the hearing aid method of the user device according to another exemplary embodiment of the present invention.

More particularly, FIG. 11 is directed to the case where the user device 100 operates after switching to the hearing aid mode automatically by referencing the recipient information.

Referring now to FIG. 11, at step 1101*a* call request from the user is received. The control unit 180 detects the user input for placing a call.

At step 1103, the control unit 180 checks the contact information on the recipient.

Next at step 1105, the control unit 180 determines whether there is any hearing impairment information mapped to the contact information.

At step 1105, when there is no hearing impairment information mapped to the contact information, then at step 1107 the control unit 180 controls to process the normal call establishment procedure according to the service operation method.

For example, the control unit 180 can place a call through a normal procedure, i.e. normal voice call mode based on the contact information. The control unit 180 can also perform a call setup request transmission and retransmission in response to the feedback from the call server as described with reference to FIG. 10.

If at step 1105 the control unit 180 determines that there is any hearing impairment information mapped to the contact information, then at step 1109 the control unit 180 switches from the normal voice call mode to the hearing aid telecommunication mode.

At step 1111, the control unit 180 acquires the hearing impairment information mapped to the contact information.

Once the hearing impairment information (particularly, audiogram) has been acquired, than at step 1113 the control unit 180 sends a call setup request based on the contact information.

At step 1115, the control unit 180 establishes a call setup with the recipient device upon receipt of the call setup response.

At step 1115, once the call setup has been with the recipient device, the control unit 180 controls to process the voice communication in the hearing aid telecommunication mode. In other words, the control unit 180 enhances the user's voice input through the microphone 143 based on the acquired hearing impairment information (particularly, audiogram) and sends the recipient device the enhanced voice by means of the radio communication unit 110.

Although the description has been directed to the case where the user device switches to the hearing aid telecommunication mode before establishing the call setup with another device in FIGS. 10 and 11, the present invention can be implemented in such a way that the user device switches to the hearing aid mode in response to the user request in the state that the call setup has been established. In other words, the user device can switch from the normal voice call mode to the hearing aid telecommunication mode or vice versa according to the user's intention.

As described above, the speaker-oriented hearing aid function provision method and apparatus of the present invention is advantageous in that the user device supports various hearing aid modes in adaptation to the situation. The speaker-oriented hearing aid function provision method and apparatus is capable of sharing the hearing impairment information of the hearing impaired users and providing the recipient with the audio enhanced based on the hearing impairment information of the recipient through a speaker in the face-to-face communication situation or over the radio channel in the hearing aid voice call situation, thereby improving hearing aid functionality of the user device regardless of environmental situation.

Also, the speaker-oriented hearing aid function provision method and apparatus of the present invention is capable of removing noise from the input audio and enhancing the noise-removed voice based on the hearing impairment information of the recipient to output enhanced voice to the hearing impaired recipient, resulting in improvement of hearing aid functionality.

Additionally, the speaker-oriented hearing aid function provision method and apparatus of the present invention is advantageous in implementing various types of hearing-aid function-enabled user devices. The speaker-oriented hearing aid function provision method and apparatus of the present invention is advantageous in implementing optimal environment for supporting hearing aid function of the user device. Furthermore, the speaker-oriented hearing aid function provision method and apparatus of the present invention is advantageous in improving device utilization, user convenience, and device competitiveness.

The above-described exemplary embodiments of the present invention can be implemented in the form of computer-executable program commands and stored in a non-transitory computer-readable storage medium. The computer readable storage medium may store the program commands, data files, and data structures in individual or combined forms. The program commands recorded in the storage medium may be designed and implemented for various exemplary embodiments of the present invention or used by those skilled in the computer software field.

The above-described methods according to the present invention can be implemented in hardware, firmware or as software or computer code that configures hardware for operation, and is stored on a non-transitory machine readable medium such as a CD ROM, DVD, RAM, a floppy disk, a hard disk, or a magneto-optical disk, such as a floptical disk or computer code downloaded over a network originally stored on a remote recording medium or a non-transitory machine readable medium and stored on a local non-transitory recording medium, so that the methods described herein can be loaded into hardware such as a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. In addition, an artisan understands and appreciates that a "processor" or "microprocessor" constitutes hardware in the claimed invention. Under the broadest reasonable interpretation, the appended claims constitute statutory subject matter in compliance with 35 U.S.C. §101.

The terms "unit" or "module" as used herein is to be understood under the broadest reasonable interpretation as constituting hardware such as a processor or microprocessor configured for a certain desired functionality in accordance with statutory subject matter under 35 U.S.C. §101 and does not constitute software per se.

While the invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. A hearing aid function provision method of a device, the method comprising:

determining a sub-mode of a current hearing aid mode of the device, the sub-mode comprising a hearing aid speaker mode and a hearing aid telecommunication mode;

if the sub-mode is the hearing aid speaker mode, enhancing input audio based on a hearing impairment information of a user of the device or another user of an external device, and outputting the enhanced audio through a speaker; if the sub-mode is the hearing aid telecommunication mode, enhancing input audio based on a hearing impairment information of the another user, and transmitting the enhanced audio to the external device through a communication unit;

determining, by a control unit, whether a sub-mode of the hearing aid speaker mode comprises a privacy mode or a public mode;

outputting, when the sub-mode comprises the privacy mode, the audio enhanced based on the hearing impairment information of an owner of the device to the speaker;

determining, when the sub-mode comprises the public mode, whether an audio output terminal is opened;

outputting, when the audio output terminal is opened, one of first and second audios through the speaker of the device according to a sub-mode of the public mode; and outputting, when the audio output terminal is unopened, the first and second audios to the speaker and audio output terminal, respectively.

2. The method of claim 1, wherein the audio input comprises a voice input of the device owner and a sound effect generated by the device.

3. The method of claim 1, further comprising:

acquiring, by a control unit, a contact information of an hearing impaired person to whom a call setup request is addressed;

acquiring, by the control unit, a hearing impairment information mapped to the contact information;

enhancing, by an audio enhancement unit, audio input through a microphone based on the acquired hearing impairment information; and outputting the enhanced audio by the communication unit to a receiving device of the hearing impaired person.

4. The method of claim 1, wherein the hearing impairment information is shared with others through Social Networking Service (SNS).

5. The method of claim 1, further comprising determining whether the sub-mode of the public mode comprises a host-oriented audio output mode or a guest-oriented audio output mode.

6. The method of claim 5, further comprising:

outputting, when the sub-mode of the public mode comprises the host-oriented audio output mode in a state that the audio output terminal is opened, the first audio for the device owner through the speaker of the device; and outputting, when the sub-mode of the public mode is the guest-oriented audio output mode in the state that the audio output terminal is opened, the second audio for another user through the speaker of the device.

7. The method of claim 5, further comprising:

outputting, when the sub-mode of the public mode comprises the host-oriented audio output mode in a state that the audio output terminal is unopened, the first audio for the device owner through the speaker of the device and second audio for the other user through the audio output terminal; and outputting, when the sub-mode of the public mode comprises the guest-oriented audio output mode in the state that the audio output terminal is not opened, the first audio for the device owner through the audio output terminal and the second audio for other user through the speaker of the device.

8. The method of claim 1, wherein the public mode is an operational mode for outputting the audio enhanced based on the other user in a face-to-face conversation, and the privacy mode is an operational mode for outputting the audio enhanced based on the hearing impairment information of the device user.

9. A device comprising:

a non-transient storage unit which stores at least one program; and a control unit configured to control execution of the at least one program, and based on the execution, enhances an audio input based on a hearing impairment information of a device owner or a hearing impaired person engaging in a face-to-face conversation and telecommunication with the device owner and outputs the enhanced audio based on the device owner to a speaker or to the hearing impaired person by transmitting the enhanced audio based on the hearing impaired person to a device of the hearing impaired person, and wherein the control unit is further configured to:

determine whether a sub-mode of hearing aid speaker mode comprises a privacy mode or a public mode;

output, when the sub-mode comprises the privacy mode, the audio enhanced based on the hearing impairment information of the device owner to the speaker;

determine, when the sub-mode comprises the public mode, whether an audio output terminal is opened;

output, when the audio output terminal is opened, one of first and second audios through the speaker of the device according to a sub-mode of the public mode; and output, when the audio output terminal is unopened, the first and second audios to the speaker and audio output terminal, respectively.

10. The device of claim 9, further comprising:

an audio enhancement unit which enhances the audio based on the hearing impaired information in a hearing aid mode and outputs the enhanced audio through a predetermined audio path; and a switch which switches the enhanced audio to the audio path according to a switching signal generated by the control unit.

11. The device of claim 10, wherein the control unit generates the switching signal to the switch in the hearing aid mode, for establishing the audio path to a speaker in a hearing aid speaker mode or a communication unit in a hearing aid telecommunication mode.

12. A non-transitory computer-readable storage medium which stores a program comprising machine executable code for configuring a control unit of a device according to claim 10, where the control unit is further configured to control a hearing aid mode in adaptation to a hearing aid application environment, enhance input audio based on a hearing impairment information shared through Social Network Service (SNS) in the hearing aid mode, and output the enhanced audio to a speaker or for transmission by a wireless communication device.

* * * * *